US006244066B1

(12) United States Patent
LaRose

(10) Patent No.: US 6,244,066 B1
(45) Date of Patent: Jun. 12, 2001

(54) FLOATING COOLER

(76) Inventor: Aaron J. LaRose, P.O. Box 68, Dittmer, MO (US) 63023

( * ) Notice: Subject to any disclaimer, the term of this patent is extended or adjusted under 35 U.S.C. 154(b) by 0 days.

(21) Appl. No.: 09/562,825

(22) Filed: May 1, 2000

(51) Int. Cl.[7] ..... F25D 3/08
(52) U.S. Cl. ..... 62/457.7; 62/371; 220/560
(58) Field of Search ..... 62/457.7, 457.2, 62/371; 220/560; 114/256

(56) References Cited

U.S. PATENT DOCUMENTS

| | | | | |
|---|---|---|---|---|
| 3,367,525 | * | 2/1968 | Elder | 220/1 |
| 4,871,079 | * | 10/1989 | Doucette et al. | 220/1 R |
| 4,927,041 | * | 5/1990 | Hepburn | 220/20 |
| 5,337,911 | * | 8/1994 | Holub | 220/254 |
| 5,435,261 | * | 7/1995 | Androus | 114/256 |
| 5,548,972 | * | 8/1996 | Wallace | 62/371 |
| 6,016,933 | * | 1/2000 | Daily et al. | 220/560 |
| 6,041,931 | * | 3/2000 | Jacques | 206/505 |
| 6,085,926 | * | 7/2000 | Weiss | 220/23.86 |

* cited by examiner

*Primary Examiner*—William Doerrler
*Assistant Examiner*—Melvin Jones
(74) *Attorney, Agent, or Firm*—Donald J. Ersler

(57) ABSTRACT

A floating cooler includes a container, a first lid, and a second lid. The container includes a bottom and a peripheral wall extending upward from the bottom. The bottom includes an inside layer, an outside layer, and an insulating layer is disposed between the inside and outside layers. The peripheral wall includes an inside wall, an outside wall, and a combination insulation/air bag layer disposed between the inside and outside walls. A water drain is preferably attached to the peripheral wall at an end, near the bottom thereof. A pair of free swinging handles are disposed on each end of the peripheral wall at substantially a top thereof. The first lid is pivotally attached to the top of the peripheral wall. The first lid is retained against the top of the peripheral wall with a pair of locking latches. An opening is formed through the first lid, the opening is sized to receive the second lid. The second lid is pivotally attached to the top of the first lid. The second lid is preferably secured to the first lid with a sliding locking latch. A second embodiment of the floating cooler does not include the second lid.

16 Claims, 5 Drawing Sheets

FLOATING COOLER

BACKGROUND OF THE INVENTION

1. Field of the Invention

The present invention relates generally to coolers and more specifically to a floating cooler which may be pulled behind a raft or canoe and which will not sink even if submersed in water.

2. Discussion of the Prior Art

Currently, it appears that floating or submersible coolers are not available for retail purchase. A floating or submersible cooler is desirable, because prior art coolers will take-on water when submersed and may even open-up with the result of the items stored therein floating away. A canoe will sometimes be big enough to store a cooler. However, canoes often tip over with the result of the cooler being submersed in water. Sometimes, there is not enough room in a raft, boat, or canoe for one extra item and a floating cooler would solve the space problem.

Accordingly, there is a clearly felt need in the art for a floating cooler which may be submersed in water without water penetrating the storage area therein and which floats in water.

SUMMARY OF THE INVENTION

The present invention provides a floating cooler which may be pulled behind a watercraft and will not take on water if submersed. The floating cooler includes a container, a first lid, and a second lid. The container includes a bottom and a peripheral wall extending upward from the bottom. The bottom includes an inside layer, an outside layer, and an insulating layer disposed between the inside and outside layers. The peripheral wall includes an inside wall, an outside wall, and a combination insulation/air bag layer disposed between the inside and outside walls. A water drain is preferably formed in the peripheral wall near the bottom. A pair of free swinging handles are disposed on each end of the peripheral wall near a top thereof.

The first lid is pivotally attached to the top of the peripheral wall, preferably with a pair of hinges. The first lid is retained against the top of the peripheral wall with a pair of locking latches. The first lid includes a hollow shell filled with an insulating material. An opening is formed through the first lid, the opening is sized to receive the second lid. The second lid is pivotally attached to the top of the first lid, preferably with a pair of hinges. The second lid is preferably secured to the first lid with a sliding locking latch.

A second embodiment of the floating cooler includes a container and a single lid. The opening in the lid where the second lid would normally fit is replaced with a combination insulation/air bag layer disposed between extended inside and outside walls.

Accordingly, it is an object of the present invention to provide a floating cooler which floats in water and may be pulled behind a watercraft.

It is a further object of the present invention to provide a floating cooler which is sealed to prevent water from leaking into the container when submerged in water.

Finally, it is another object of the present invention to provide a floating cooler which will stay closed when turned upside down or jarred against an object.

These and additional objects, advantages, features and benefits of the present invention will become apparent from the following specification.

DETAILED DESCRIPTION OF THE PREFERRED EMBODIMENTS

Figure 1:
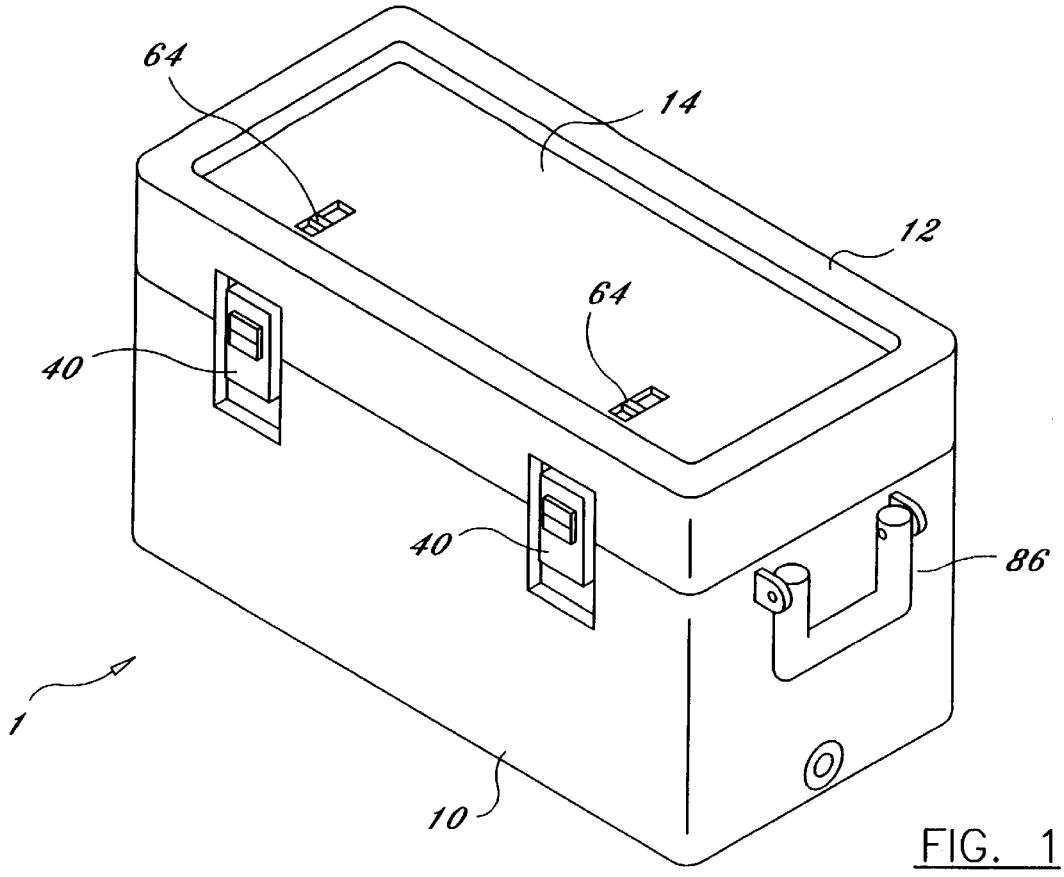
FIG. 1 is a perspective view of a floating cooler in accordance with the present invention.
Figure 2:
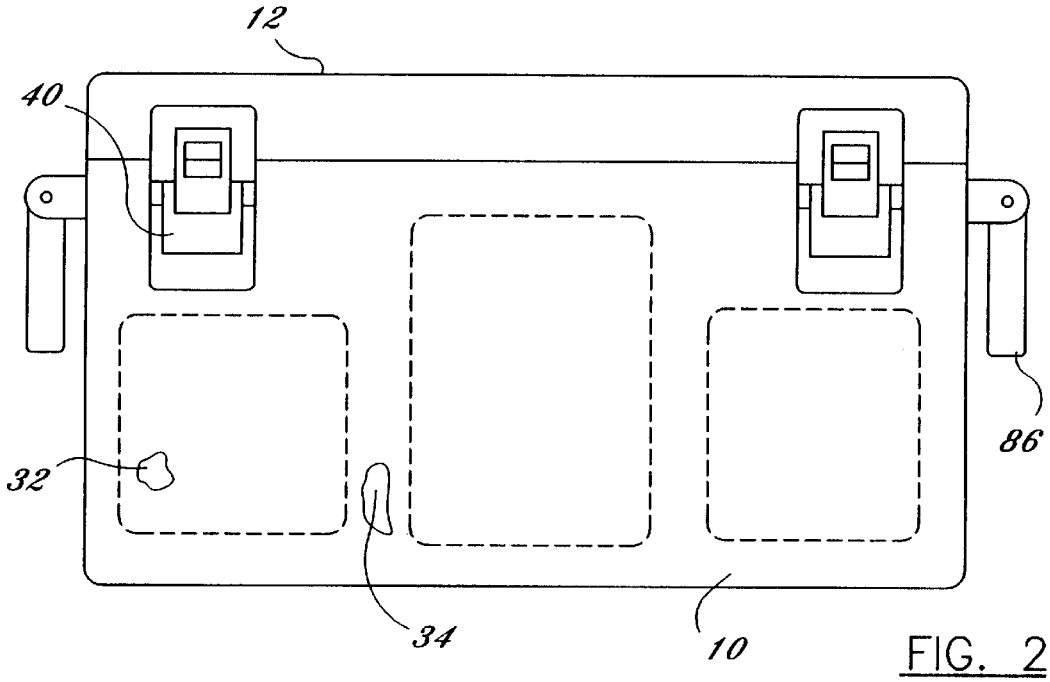
FIG. 2 is a front view of a floating cooler in accordance with the present invention.
Figure 3:
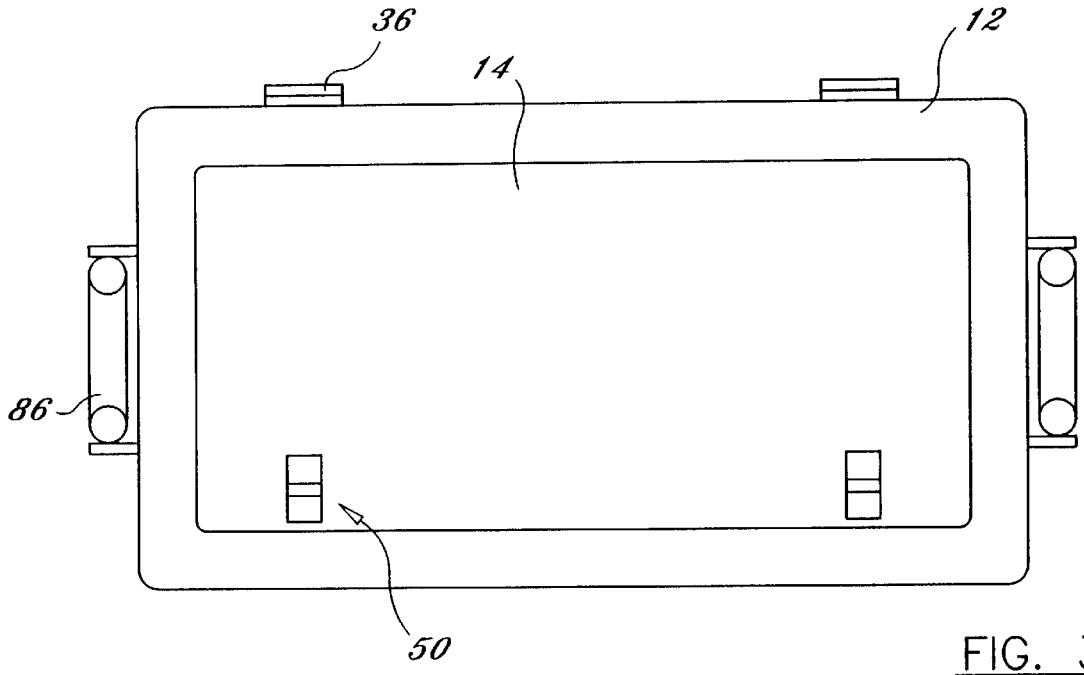
FIG. 3 is a top view of a floating cooler in accordance with the present invention.
Figure 4:
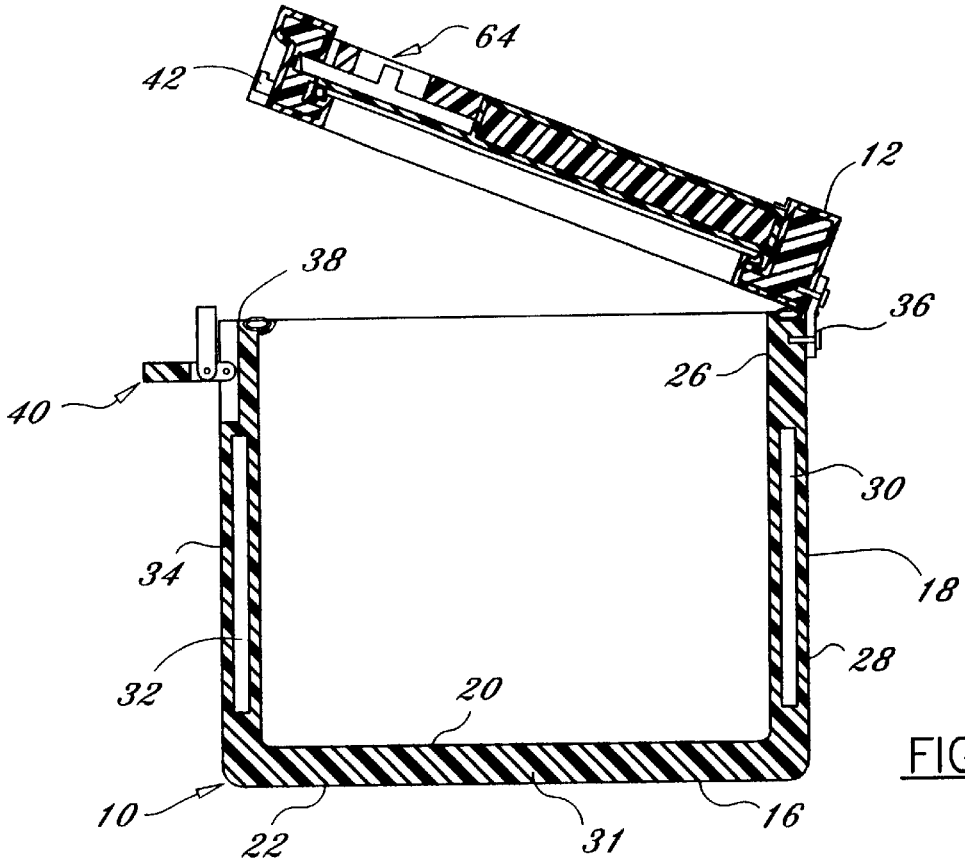
FIG. 4 is an end cross-sectional view of a floating cooler with a first lid partially opened in accordance with the present invention.

With reference now to the drawings, and particularly to FIG. 1, there is shown a perspective view of a floating cooler 1. With reference to FIGS. 2–4, the floating cooler 1 includes a container 10, a first lid 12, and a second lid 14. The container 10 includes a bottom 16 and a peripheral wall 18. A pair of free swinging handles 86 are preferably disposed on each end of the peripheral wall 18 at substantially a top thereof. The bottom 16 includes an inside layer 20, an outside layer 22, and an insulating layer 31 disposed between the inside and outside layers. The peripheral wall 18 includes an inside wall 26, an outside wall 28, and a combination insulation/air bag layer 30 disposed between the inside and outside walls. The inside wall 26 extends upward from the inside layer 20 and the outside wall 28 extends upward from the outside layer 22. The insulation/air layer 30 preferably includes a plurality of plastic bags 32 filled with air that are over molded with an insulation material 34. The plastic bags 32 filled with air enable the floating cooler to have buoyancy in water.

The inside layer 20 and inside wall 26; insulation/air layer 30 and insulation layer 31; outside layer 22 and outside wall 28 are preferably three separate layers. The outside layer 22 and outside wall 28 are preferably an outside shell. The insulation/air layer 30 and insulation layer 31 are placed inside the outside shell. The inside layer 20 and inside wall 26 are preferably an inside shell which is placed inside the insulation/air layer 30 and insulating layer 31. The inside layer 20, inside wall 26, insulation/air layer 30, insulating layer 31, outside layer 22, and outside wall 28 could also be a single piece of material.

Figure 5:
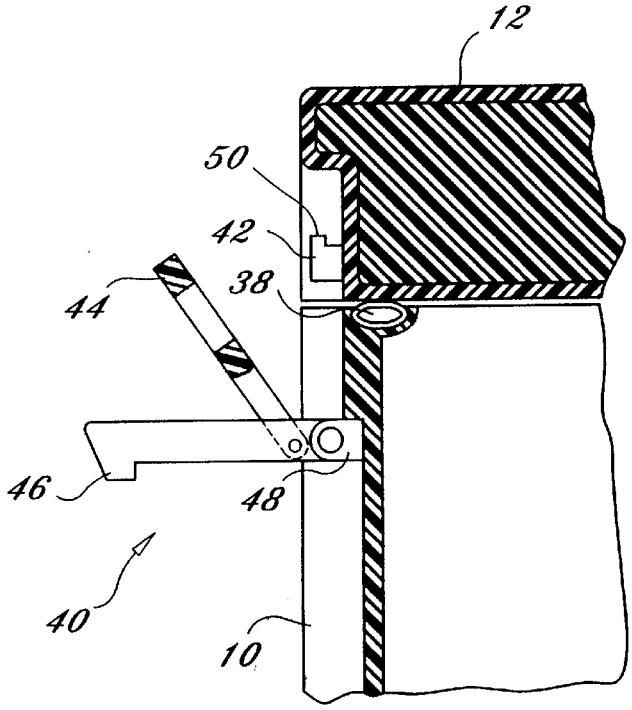
FIG. 5 is an enlarged view of a locking latch for retaining a first lid or lid against a container in accordance with the present invention.

The first lid 12 is pivotally attached to the top of the peripheral wall 18, preferably with a pair of hinges 36. A first gasket 38 provides a water tight seal between a bottom of the first lid 12 and the top of the peripheral wall 18. The first lid 12 is retained against the top of the peripheral wall 18 with a pair of locking latches 40. With reference to FIG. 5, the locking latch 40 preferably includes a catch 42, a latch 44, a lever 46, and a lever mount 48. The pair of locking latches 40 are preferably mounted flush with the outer surface of the first lid 12 and the container 10. The catch 42 is mounted to the first lid 12 and has a retaining projection 50. The latch 44 has an opening 52 formed therethrough on one end to provide clearance for the catch 42. The latch 44 is retained by the retaining projection 50. The other end of the latch 44 is pivotally attached to the lever 46. An end of the lever 46 is pivotally attached to the lever mount 48. To lock the locking latch 40, the lever 46 is raised and the latch 44 is placed over the catch 42 and behind the retaining projection 50. The lever 46 is pushed downward until it locks. The invention should not be limited to the locking latch 40, but should include any other type or design of locking latches.

The first lid 12 includes a hollow shell 54 filled with an insulating material 56. An opening 58 is formed through the first lid 12, the opening 58 is sized to receive the second lid 14. The second lid 14 is pivotally attached to a top of the first lid 12, preferably with a pair of hinges 60. A gasket 62 provides a seal between a bottom of the second lid 14 and the opening 58 in the first lid 12. The second lid 14 is preferably secured to the first lid 12 with a sliding locking latch 64.

Figure 3A:
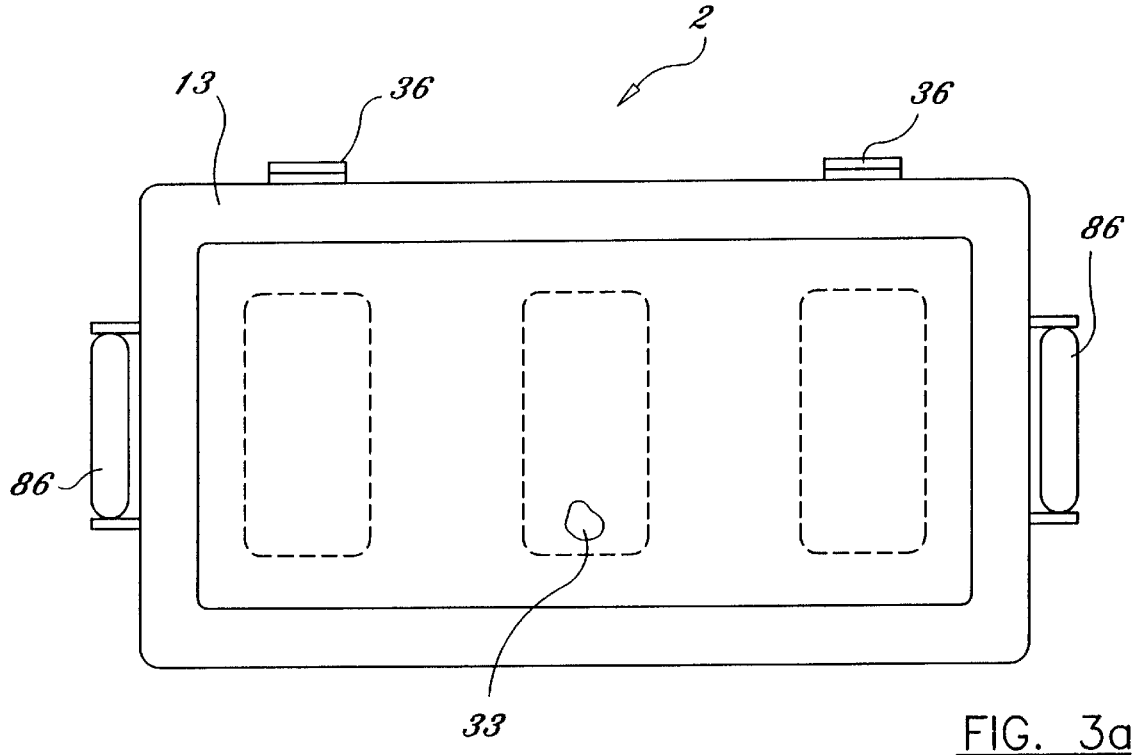
FIG. 3*a* is a top view of a second embodiment of a floating cooler in accordance with the present invention.
Figure 6:
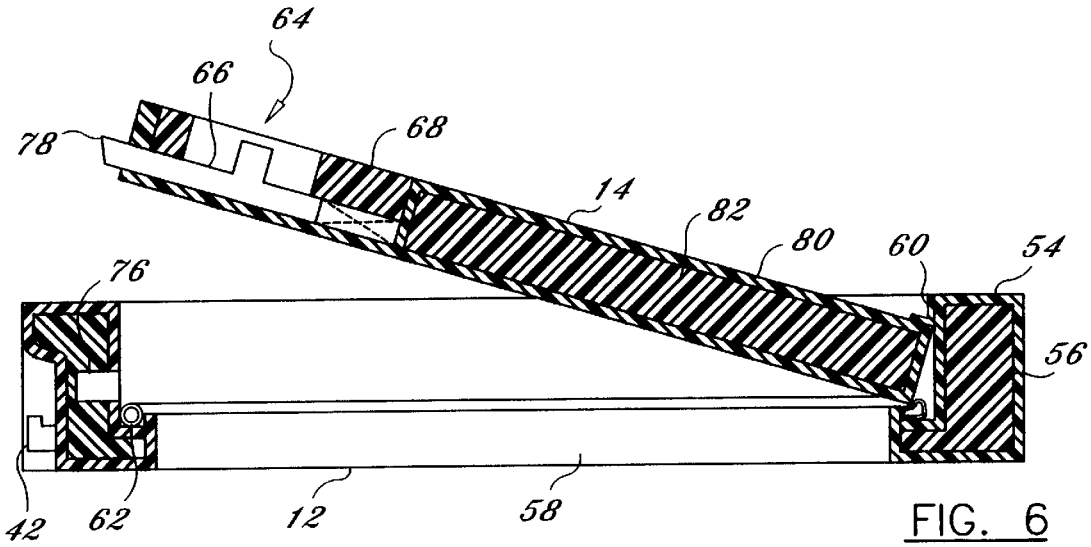
FIG. 6 is an end cross-sectional view of a floating cooler with a second lid partially opened in accordance with the present invention.
Figure 6A:
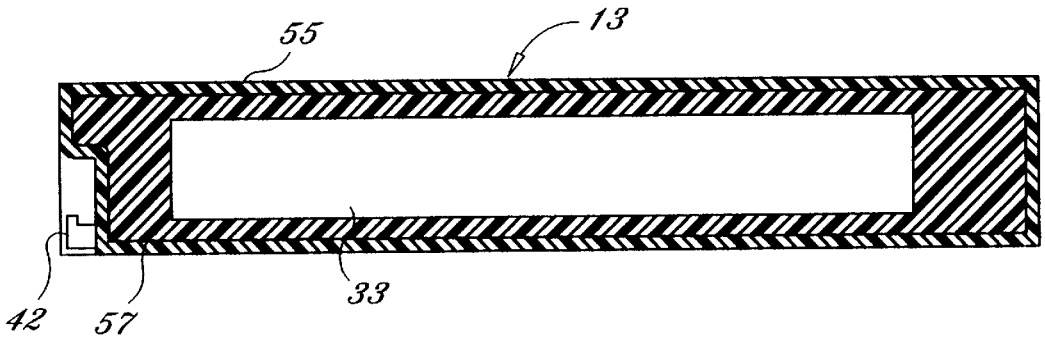
FIG. 6*a* is an end cross-sectional view of a lid of a second embodiment of a floating cooler in accordance with the present invention.

With reference to FIGS. 3*a* and 6*a*, a second embodiment of a floating cooler 2 includes the container 10 and a lid 13. The lid 13 preferably includes a hollow shell 55 filled with an insulating material 57. At least one air bag 33 filled with air is over molded with the insulation material 57. The lid 13 is pivotally attached to the container 10, preferably with a pair of hinges 36. A pair of catches 42 extend outward from a front of the lid 13 for engagement with a pair of latches 44 extending from the container 10. The same pair of locking latches 40 which are used to retain the first lid 12 against the container 10 are also used for retaining the lid 13 against the container 10. The pair of locking latches 40 are preferably mounted flush with the outer surface of the first lid 13 and the container 10. The first gasket 38 provides a water tight seal between a bottom of the lid 13 and the top of the peripheral wall 18 of the container 10. The at least one air bag 33 provides extra flotation if the floating cooler 2 is submerged.

Figure 7:
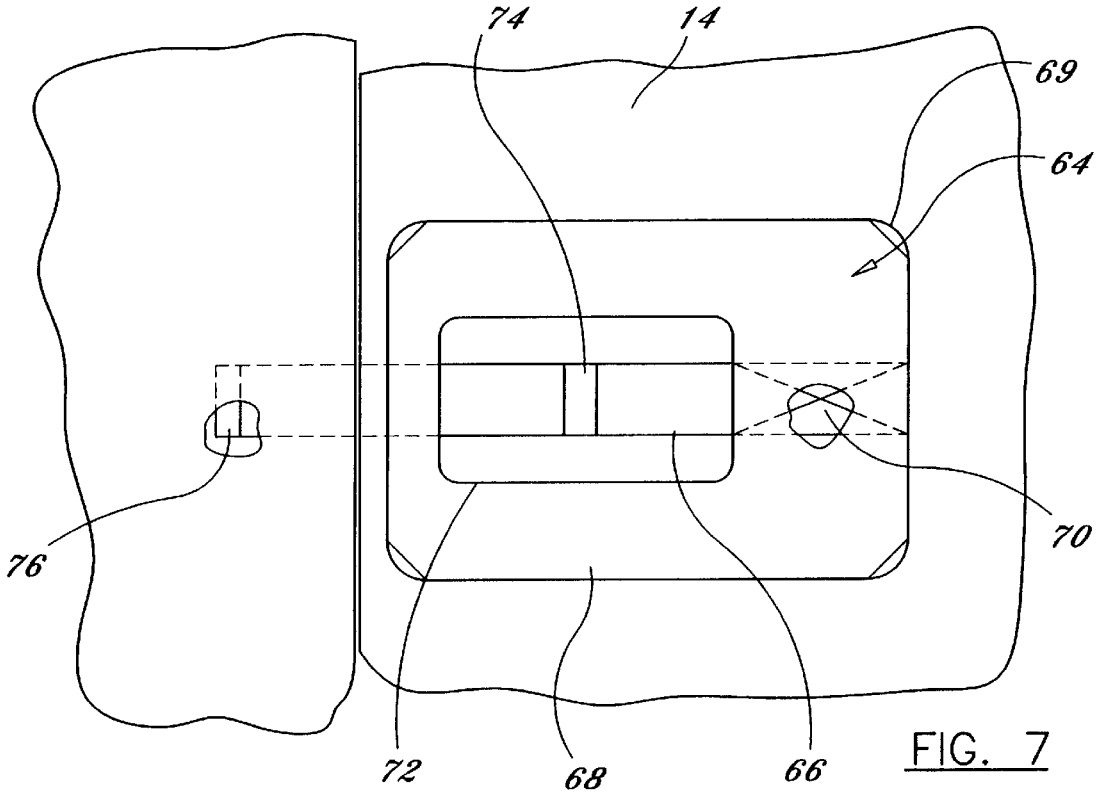
FIG. 7 is an enlarged top view of a sliding locking latch for retaining a second lid against a first lid in accordance with the present invention.

With reference to FIGS. 6 and 7, the sliding locking latch 64 preferably includes a sliding pin 66, a retaining plate 68, and a spring 70. The spring 70 maintains the sliding pin 66 in an extended position. A cavity 69 is formed in a top of the second lid 14 which is sized to receive the retaining plate 68. The retaining plate 68 is attached to the second lid 14 with any suitable assembly method such as a water resistant adhesive. The retaining plate 68 has a tab opening 72 formed therethrough which allows a user to retract a tab 74 extending from a top of the sliding pin 66. The first lid 12 has a pin opening 76 which is sized to slidably receive an end of the sliding pin 66. The end of the sliding pin 66 has a chamfer 78 formed on a front thereof which allows the second lid 14 to be locked to the first lid 12 by pushing the second lid 14 down without moving the tabs 74. The second lid 14 is withdrawn from the first lid 12 by pushing back the tabs 74. The invention should not be limited to the sliding locking latch 64, but should include any other type or design of locking latch. The second lid 14 includes a hollow shell 80 filled with an insulating material 82.

Figure 8:
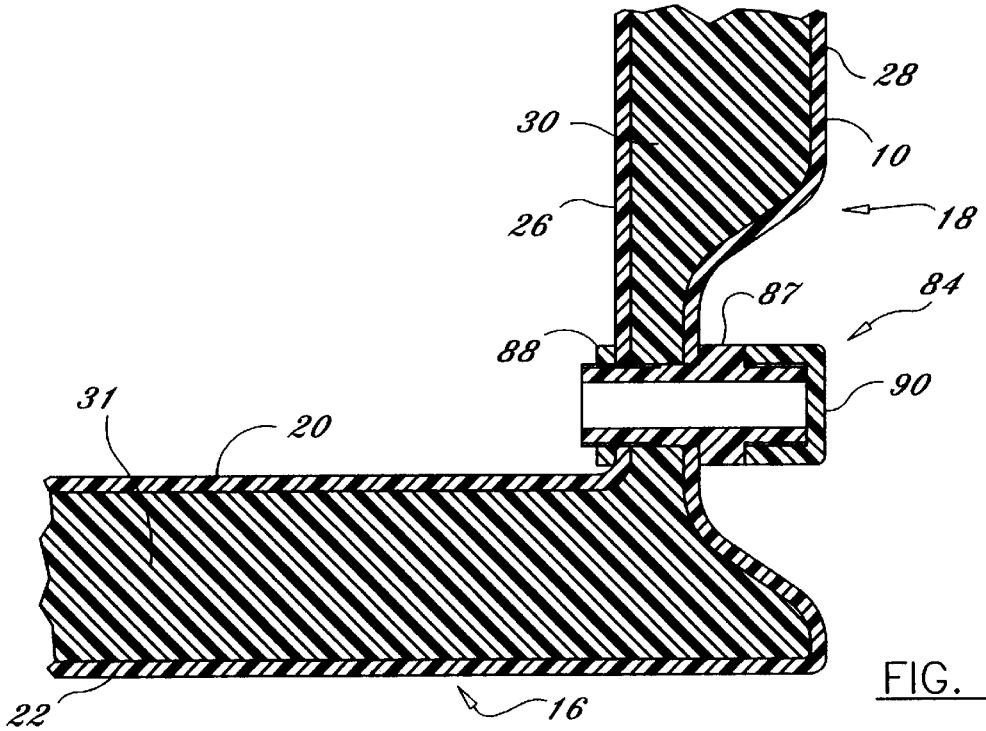
FIG. 8 is an enlarged view of a water drain in accordance with the present invention.

With reference to FIG. 8, a water drain 84 is preferably attached to the peripheral wall 18 near the bottom 16. The water drain 84 includes a tube body 87 with threads on both ends. One end of the tube body 87 is inserted through a hole in the peripheral wall 18 and attached thereto with a nut 88. A cap 90 is threaded on the other end of the tube body 87. Water is drained from the floating cooler 1 by unthreading the sealing cap 90. The water drain could also be a water dispenser from a jug.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A floating cooler comprising:

an insulating material;

a container having a peripheral wall extending from a bottom, said insulating material being formed in said wall and said bottom;

a lid being pivotally attached to a top of said peripheral wall, said lid being secured to said container with at least one locking latch, said insulating material being formed in said first lid; and at least one air bag being formed within said insulating material.

2. The floating cooler of claim 1, further comprising:

a gasket being formed on said top of said peripheral wall, said gasket providing a water tight seal between said lid and said container.

3. The floating cooler of claim 1, further comprising:

a pair of swinging handles, one said swinging handle being attached to each end of said floating cooler.

4. The floating cooler of claim 1, further comprising:

a water drain being attached to one end of said container near said bottom to allow water to be drained from an inside thereof.

5. The floating cooler of claim 1, wherein:

each said locking latch including a catch, a latch, a lever and a lever mount, said catch being mounted to said lid, said lever mount being attached to said peripheral wall, a lever being pivotally attached to said lever mount, one end of said latch being pivotally mounted to said lever, the other end of said latch being capable of locking on said catch.

6. A floating cooler comprising:

an insulating material;

a container having a peripheral wall extending from a bottom, said insulating material being formed in said wall and said bottom;

a lid being pivotally attached to a top of said peripheral wall, said lid being secured to said container with at least one locking latch, said insulating material being formed in said first lid;

at least one air bag being formed within in said insulating material; and a gasket being formed on said top of said peripheral wall, said gasket providing a water tight seal between said lid and said container.

7. The floating cooler of claim 6, further comprising:

a pair of swinging handles, one said swinging handle being attached to each end of said floating cooler.

8. The floating cooler of claim 6, further comprising:

a water drain being attached to one end of said container near said bottom to allow water to be drained from an inside thereof.

9. The floating cooler of claim 6, wherein:

each said locking latch including a catch, a latch, a lever and a lever mount, said catch being mounted to said lid, said lever mount being attached to said peripheral wall, a lever being pivotally attached to said lever mount, one end of said latch being pivotally mounted to said lever, the other end of said latch being capable of locking on said catch.

10. A floating cooler comprising:

an insulating material;

a container having a peripheral wall extending from a bottom, said insulating material being formed in said wall and said bottom;

at least one air bag being formed within in said insulating material;

a first lid being pivotally attached to a top of said peripheral wall, said first lid being secured to said container with at least one first locking latch; and a second lid being pivotally attached within said first lid, said second lid being secured to said first lid with at least one second locking latch.

11. The floating cooler of claim 10, further comprising:

a first gasket being formed on said top of said peripheral wall, said first gasket providing a water tight seal between said first lid and said container.

12. The floating cooler of claim 10, further comprising:

a second gasket being formed within said first lid, said second gasket providing a water tight seal between said first lid and said second lid.

13. The floating cooler of claim 10, further comprising:

a pair of swinging handles, one said swinging handle being attached to each end of said floating cooler.

14. The floating cooler of claim 10, further comprising:

a water drain being attached to one end of said container near said bottom to allow water to be drained from an inside thereof.

15. The floating cooler of claim 10, wherein:

each said locking latch including a catch, a latch, a lever and a lever mount, said catch being mounted to said lid, said lever mount being attached to said peripheral wall, a lever being pivotally attached to said lever mount, one end of said latch being pivotally mounted to said lever, the other end of said latch being capable of locking on said catch.

16. The floating cooler of claim 10, wherein:

each said second locking latch being a sliding locking latch, said sliding locking latch including a sliding pin, a retaining plate, and a spring, a cavity being formed in a top of said second lid which is sized to receive said retaining plate, said sliding pin and said spring being slidably constrained within said retaining plate, a pin hole being formed within said first lid which is sized to receive an end of said sliding pin, a tab being formed on a top of said sliding pin to allow thereof to be retracted.

* * * * *